US006017430A

United States Patent [19]

Hodgson et al.

[11] Patent Number: 6,017,430

[45] Date of Patent: Jan. 25, 2000

[54] CATHODE FOR USE IN ELECTROLYTIC CELL

[75] Inventors: David Ronald Hodgson, Wigan; Francis Rourke, Wincham, both of United Kingdom

[73] Assignee: Imperial Chemical Industries PLC, London, United Kingdom

[21] Appl. No.: 08/875,907

[22] PCT Filed: Jan. 26, 1996

[86] PCT No.: PCT/GB96/00157

§ 371 Date: Aug. 6, 1997

§ 102(e) Date: Aug. 6, 1997

[87] PCT Pub. No.: WO96/24705

PCT Pub. Date: Aug. 15, 1996

[30] Foreign Application Priority Data

Feb. 11, 1995 [GB] United Kingdom ..... 9502665

[51] Int. Cl.[7] ..... C25B 11/00

[52] U.S. Cl. ..... 204/290 R; 204/293; 204/192.1; 204/192.11; 204/192.12; 204/192.15; 204/192.16; 427/78; 427/77; 427/248.1; 427/250; 427/126.3; 427/126.5; 427/372.2; 427/383.1; 427/383.5

[58] Field of Search ..... 204/290 F, 290 R, 204/293, 192.1, 192.11, 192.12, 192.15, 192.16; 429/40, 44, 45; 427/78, 77, 126.3, 126.5, 248.1, 250, 372.2, 383.1, 383.5

[56] References Cited

U.S. PATENT DOCUMENTS

| | | | |
|---|---|---|---|
| 4,724,169 | 2/1988 | Keem et al. | 204/192.16 |
| 5,324,395 | 6/1994 | Paul et al. | 204/290 R |
| 5,334,293 | 8/1994 | Cairns et al. | 204/290 F |

FOREIGN PATENT DOCUMENTS

| | | |
|---|---|---|
| 0 099 867 | 2/1984 | European Pat. Off. . |
| 0 546 714 | 6/1993 | European Pat. Off. . |
| 43 19 951 | 12/1994 | Germany . |
| 2 074 190 | 10/1981 | United Kingdom . |

*Primary Examiner*—Bruce F. Bell

[57] ABSTRACT

A cathode wherein the electrocatalytically-active outer layer is of substantially uniform thickness and has contours which are at least substantially the same as the contours of the substrate immediately underlying it. The electrode may be prepared by depositing the electrocatalytically-active outer layer by physical vapour deposition. The electrocatalytically-active outer layer comprises (a) cerium and/or cerium oxide and at least one non-noble Group 8 metal or (b) platinum and/or platinum oxide and ruthenium and/or ruthenium oxide.

15 Claims, 1 Drawing Sheet

CATHODE FOR USE IN ELECTROLYTIC CELL

BACKGROUND OF THE INVENTION

This invention relates to a cathode for use in an electrolytic cell, and in particular to a cathode which has a low hydrogen over-voltage when used in the electrolysis of water or brine, eg aqueous alkali metal chloride solutions, and to a method for the preparation of the cathode, The voltage at which a solution may be electrolysed at a given current density is made up of and is influenced by a number of features, namely the theoretical electrolysing voltage, the over-voltages at the anode and cathode, the resistance of the solution which is electrolysed, the resistance of the diaphragm, if any, positioned between the anode and cathode, and the resistance of the metallic conductors and their contact resistance.

As the cost of electrolysis is proportional to the voltage at which electrolysis is effected, and in view of the high cost of electrical power, it is desirable to reduce the voltage at which a solution is electrolysed to as low a voltage as possible. In the electrolysis of water and aqueous solutions there is considerable scope for achieving such a reduction in the electrolysing voltage by reducing the hydrogen over-voltage at the cathode.

There have been many proposals of means of achieving such a reduction in hydrogen over-voltage.

For example, it is known that the hydrogen over-voltage at a cathode may be reduced by increasing the surface area of the cathode, eg by etching the surface of the cathode in an acid, or by grit-blasting the surface of the cathode, or by coating the surface of the cathode with a mixture of metals, eg a mixture of nickel and aluminium, and selectively leaching one of the metals, eg aluminium, from the coating.

Other methods of achieving a low hydrogen over-voltage cathode which have been described involve coating the surface of the cathode with an electrocatalytically-active material which comprises a platinum group metal and/or oxide thereof as mentioned in for example U.S. Pat. No. 4,100,049 (wherein the coating is appplied from an aqueous solution and then fired), GB 1,511,719 (wherein the coating is applied by electroplating), Japanese Patent Publications Nos. 54090080 (wherein the coating is applied by sinter coating), 54110983 (wherein the coating is applied as a dispersion) and 53100036 and EP 0,129,374 (wherein the coating is applied in the form of salts which are then fired).

In our EP 0,546,714 there is described a cathode for use in an electrolytic cell which has a low hydrogen over-voltage when used in the electrolysis of water or aqueous solutions and which does not depend for its effectiveness on the presence of a coating containing a platinum group metal or oxide thereof The cathode for use in an electrolytic cell disclosed in EP 0,546,714 comprises a metallic substrate and a coating thereon having at least an outer layer comprising a cerium oxide and at least one non-noble Group 8 metal wherein the cerium oxide provides at least 10% and preferably at least 20% by X-ray diffraction analysis of the outer layer.

We have now found surprisingly that cathodes for use in electrolytic cells may be prepared by the physical vapour deposition (PVD) on a suitable substrate of a coating comprising (a) cerium and/or cerium oxide and a non-noble Group 8 metal or (b) platinum and/or platinum oxide and ruthenium and/or ruthenium oxide. Furthermore, we have found that the durability of the cathode may be improved by a subsequent heat treatment.

SUMMARY OF THE INVENTION

The present invention provides an electrode, and a method for the preparation thereof, which (a) comprises a metallic substrate and a coating thereon which comprises an outer layer of good electrocatalytic activity and of uniform thickness which follows the contours of the surface of the substrate and (b) when used as a cathode in an electrolytic cell in which hydrogen is evolved at a cathode has an acceptable over-voltage and high durability.

According to the first aspect of the present invention there is provided a cathode which comprises a metallic substrate and a coating thereon comprising an outer layer which comprises an electrocatalytically-active material characterised in that (a) the outer layer is of substantially uniform thickness and (b) the contours of the surface of the outer layer are at least substantially the same as the contours of the substrate immediately underlying it.

In the cathode according to the present invention, the electrocatalytically-active material comprises (a) cerium and/or cerium oxide and at least one non-noble Group 8 metal or (b) platinum and/or platinum oxide and ruthenium and/or ruthenium oxide.

The cathode according to the present invention affords the advantages of an increased surface area for a given mass of electrocatalytically-active material and the more efficient use thereof to obtain a minimum thickness thereof.

Where the outer layer of the coating on the cathode according to the present invention contains cerium and/or cerium oxide we do not exclude the possibility that it may contain one or more other metals of the lanthanide series, eg lanthanum itself that is some of the cerium may be replaced by one or more other lanthanide metals. However, where such other metal of the lanthanide series is present in the outer layer it should provide less than 2% w/w thereof and cerium should be present as the major amount of the total metal of the lanthanide series, including cerium.

Where the outer layer of the coating on the cathode according to the present invention comprises cerium and/or cerium oxide and a non-noble Group 8 metal the non-noble Group 8 metal may be iron, cobalt or preferably nickel. Often the outer layer of the coating comprises an intermetallic compound of cerium and a non-noble Group 8 metal, particularly nickel.

We are aware of certain prior disclosures in which the use of intermetallic compounds as low hydrogen over-voltage cathode coatings has been described, for example Doklady Akad Nauk SSSR 1984, Vol.276, No.6, pp 1424–1426; Proceedings of a Symposium on Electrochemical Engineering in the Chlor-alkali and Chlorate Industries, The Electrochemical Society, 1988, p 184–194; Journal of Applied Electrochemistry, Vol.14, 1984, pp 107–115; and EP 0,089, 141.

Where the outer layer of the coating on the cathode according to the present invention contains platinum and/or platinum oxide and ruthenium and/or ruthenium oxide it should contain 5–90 mole % platinum and preferably 10–80 mole % ruthenium.

The substrate of the cathode according to the present invention may comprise a ferrous metal, a film-forming metal or alloy thereof having properties similar thereto, eg titanium, or preferably nickel or an alloy thereof having properties similar thereto. However, it is often preferred that the substrate of the cathode is made of another material having an outer face of nickel or a nickel alloy. For example, the cathode may comprise a core of another metal, eg steel or copper, and an outer face of nickel or nickel alloy. Preferably the substrate comprises nickel or nickel alloy, such a substrate is corrosion resistant in an electrolytic cell in which aqueous alkali chloride solution is electrolysed and cathodes according to the present invention which comprise a substrate of nickel or nickel alloy have long-term low hydrogen over-voltage performance.

The substrate of the cathode according to the present invention may have any desired structure. For example, it may be in the form of a plate, which may be foraminate, eg the cathode may be a perforated plate, or it may be in the form an expanded metal, or it may be woven or unwoven. The cathode is not necessarily in plate form. Thus, it may be in the form of a plurality of so-called cathode fingers between which the anode of the electrolytic cell may be placed.

In the cathode according to the present invention the defined coating may be in direct contact with the surface of the subtrate. However, we do not exclude the possibility that the defined coating may be applied to an intermediate coating of another material on the surface of the substrate. Such an intermediate coating may be, for example, a porous nickel coating. However,the invention will be described hereinafter with reference to a cathode in which such an intermediate coating is not present.

According to a further aspect of the present invention there is provided a method for the preparation of an electrode according to the first aspect of the present invention which method comprises the steps of:

(A) depositing the outer layer of the coating on the substrate by physical vapour deposition (PVD); and (b) heating the product from Step A with the proviso that where the electrocatalytically-active material comprises cerium and/or cerium oxide the heating is carried out in a non-oxidising atmosphere.

As examples of PVD may be mentioned inter alia radio frequency (RF) sputtering, sputter ion plating, arc evaporation, electron beam evaporation, dc sputtering, reactive PVD, etc or combinations thereof It will be appreciated that where combinations of evaporation techniques are used in the same evaporation chamber in the PVD system separate targets may be used, for example a cerium target and a nickel target instead of, or in addition to, a cerium/nickel intermetallic target. By "target" we mean the material which is vapourised to produce a vapour for deposition on the substrate in the PVD system.

In Step A of the method according to the present invention, the chamber in the PVD system may be charged with oxygen or ozone and/or an inert gas. Where an inert gas is present in the chamber it is preferably argon. It will be appreciated that where the target in the PVD system is metallic and where it is desired to deposit an oxide, eg cerium oxide, platinum oxide or ruthenium oxide, an oxidising atmosphere is used in the PVD system.

The specific conditions used in Step A of the method according to the present invention may be found by the skilled man by simple experiment. For example, the pressure in the deposition chamber may be in the range $10^{-2}$ to $10^{-10}$ atmospheres.

Where the target in the PVD system in Step A of the method according to the present invention is a cerium-containing intermetallic compound for the preparation of a cathode as claimed in claim 3 it will be appreciated that it must contain at least one non-noble Group 8 metal, ie at least one of iron, cobalt and nickel as well as cerium. Intermetallic compounds containing cobalt and/or nickel, particularly nickel are preferred.

The cerium-containing intermetallic compound, where it is used, may contain one or more metals additional to cerium and a non-noble Group 8 metal but such other metals, where present, will generally be present in a proportion of not more than 2%.

The cerium-containing intermetallic compound, where it is used, may have an empirical formula $CeM_x$ wherre M is at least one non-noble Group 8 metal, x is in the range of about 1 to 5, and in which some of the cerium may be replaced by one or more other lanthanide metals as hereinbefore described.

Where a cerium-containing intermetallic compound is used as target in the PVD system in Step A of the method according to the present invention it may be a neat intermetallic compound, eg $CeNi_3$, or a mixture of intermetallic compounds, eg $CeNi_3$ and $Ce_2Ni_7$, or an intimate mixture of a metal powder, preferably Ni, with an intermetallic, eg $Ce_2Ni_7$, to form, eg notionally $CeNi_{22}$, or a cerium/nickel alloy containing $CeNi_x$ phases wherein x is 1–5.

Where a cerium-containing intermetallic compound is used as target in the PVD system in Step A of the method according to the present invention the concentration of cerium therein is typically not more than about 50% w/w and it is often preferred that it is not less than about 10% w/w.

Where platinum and ruthenium metals are used as target in the PVD system in Step A of the method according to the present invention they may be present for example as a mixed bed or a disc.

In Step B of the method according to the present invention, the temperature to which the product from Step A is heated is preferably above 300° C. and less than 1000° C. and more preferably is about 500° C. The product from Step A is preferably heated for less than 8 hours and more than 0.5 hours and more preferably for at least one hour. The typical rate of heating is between 1° C. and 50° C. per minute and preferably is in the range 10–20° C./minute.

As examples of non-oxidising atmospheres which may be used in Step B of the method according to the present invention may be mentioned inter alia a vacuum, a reducing gas, eg hydrogen, or preferably an inert gas, eg argon, or mixtures thereof, eg heating in argon followed by vacuum treatment at elevated temperature.

Where the outer layer in the cathode according to the present invention comprises platinum and/or platinum oxide and ruthenium and/or ruthenium oxide the heating in Step B is typically carried out in air.

The precise temperature to be used in Step B of the method according to the present invention depends at least to some extent on the precise method by which the outer layer of the coating is deposited in Step A.

The mechanical properties and chemical/physical composition of the outer layer of the coating on the durable electrode according to the present invention are dependent on inter alia the length of time, the rate of heating and the temperature used in Step B.

The cathode according to the present invention may be a monopolar electrode or it may form part of a dipolar electrode.

The cathode according to the present invention is suitable for use in an electrolytic cell comprising an anode, or a plurality of anodes, a cathode, or plurality of cathodes, and optionally a separator positioned between each adjacent anode and cathode. The separator, where present, may be a porous electrolyte-permeable diaphragm or it may be a hydraulically impermeable cation permselective membrane.

The anode in the electrolytic cell may be metallic, and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The structure of the cathode, and of the electrolytic cell in which the cathode is to be used, will vary depending upon the nature of the electrolytic process which is to be carried out using the cathode. However, as the inventive feature of the present invention does not reside in the nature of the electrolytic cell nor of the cathode there is no necessity for the cell or the cathode to be described in any detail. Suitable types and structures of electrolytic cell and cathode may be selected from the prior art depending on the nature of the electrolytic process to be carried out in the cell. The cathode may, for example, have a foraminate structure, as in woven or unwoven mesh, or as in mesh formed by slitting and expanding a sheet of metal or alloy thereof, although other electrode structures may be used.

Prior to deposition of the coating on the substrate in the method according to the present invention the substrate may be subjected to treatments which are known in the art. For example, the surface of the substrate may be roughened, for example by sand-blasting, in order to improve the adhesion of the subsequently applied coating and in order to increase the real surface area of the substrate. The surface of the substrate may also be cleaned and etched, for example by contacting the substrate with an acid, eg an aqueous solution of hydrochloric acid, and the acid-treated substrate may then be washed, eg with water, and dried.

BRIEF DESCRIPTION OF THE DRAWING

The present invention is further illustrated by reference to the accompanying drawing which represents by way of example only a micrograph of an electrode according to the present invention which may be prepared by the method according to the present invention.

In the drawing.

DETAIL DESCRIPTION OF THE PREFERRED EMBODIMENTS

Figure 1:
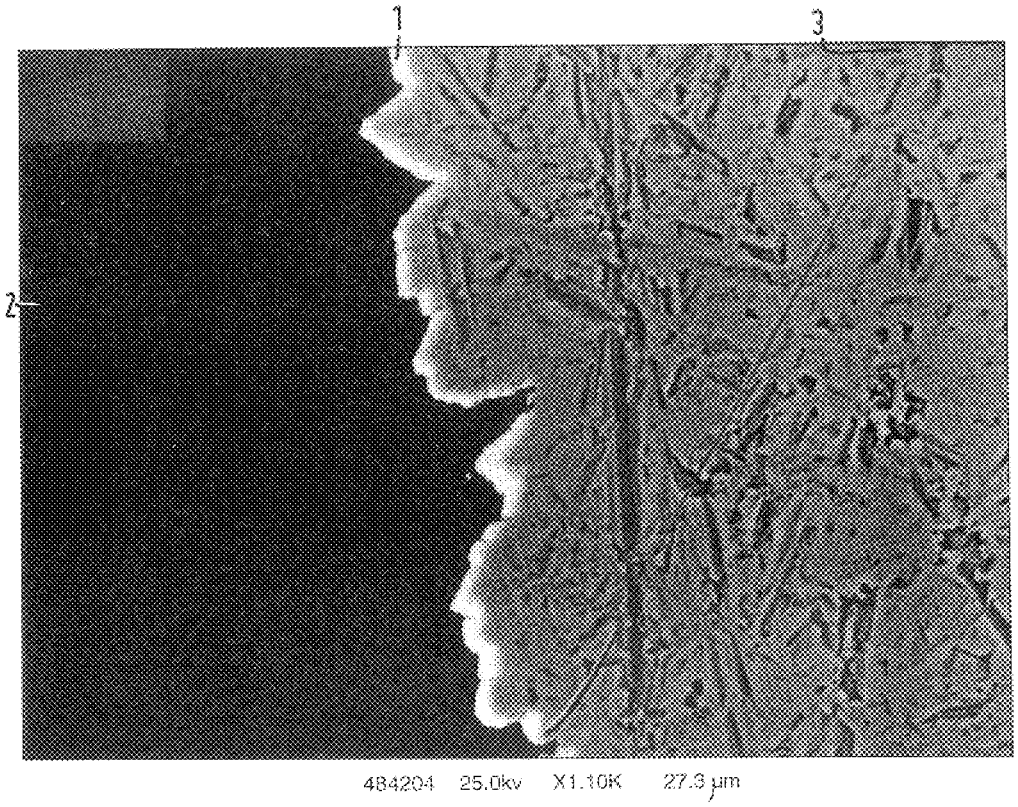
FIG. 1 is a micrograph of an electrode which may be prepared in Example 1.

In FIG. 1, (1) is the electrode coating, (2) is the electrode substrate and (3) is the base on which the electrode was mounted for preparing the micrograph.

From FIG. 1, it can be seen that the electrode coating (1) is of uniform thickness and that the contour of the surface thereof is substantially the same as the contour of the substrate immediately underlying it (2).

The present invention is further illustrated by reference to the following Examples.

EXAMPLES 1–2

These Examples illustrate cathodes according to the present invention. General method Nickel sheet was cleaned with acetone then grit-blasted with 60/80 alumina grit.

The sheet was mounted on a stainless steel plate (held with a nickel foil mask) and disposed in the PVD system which was allowed to pump down overnight.

The pressure in the PVD chamber was adjusted to $10^{-2}$ mbar by controlling the argon flow. A $CeNi_5$ powder target was presputtered for 2.5 hours at 500W incident RF power prior to use. The target shutter was removed and the powder target was sputtered for 60 hours whereupon a coating of nominal thickness 10 microns was obtained on the nickel substrate.

In Example 2, the cathode removed from the PVD chamber was subjected to a heat-treatment in argon at 500° C. for 1 hour.

The cathodes prepared in Examples 1 and 2 were tested under the conditions described in EP 0,546,714. The results of the tests are shown in the Table.

TABLE

| Example No. | Voltage saving over grit-blasted nickel/mV after 6 days at 3 kAm-2 | Voltage saving over grit-blasted nickel/mV after 1 short |
|---|---|---|
| 1 | 261 | 177 |
| 2 | 277 | 264 |
| Hydrogen over-voltage of grit-blasted nickel is taken as 350 mV | | |

From the Table it can be seen that the cathode from Example 1 has a low hydrogen over-potential whereas the cathode from Example 2 has both a low hydrogen over-potential and good durability.

We claim:

1. A cathode for use in electrolytic cell which comprises a metallic substrate and a coating thereon comprising an outer layer which comprises an electrocatalytically-active material characterised in that (a) the outer layer is of substantially uniform thickness and (b) the contours of the surface of the outer layer are at least substantially the same as the contours of the substrate immediately underlying it.

2. A cathode as claimed in claim 1 wherein the electrocatalytically-active material comprises cerium and/or cerium oxide and at least one non-noble Group 8 metal.

3. A cathode as claimed in claim 2 wherein the electrocatalytically-active material comprises an intermetallic compound of cerium and a non-noble Group 8 metal.

4. A cathode as claimed in claim 2 wherein the non-noble Group 8 metal is nickel.

5. A cathode as claimed in claim 1 wherein the electrocatalytically-active material comprises platinum and/or platinum oxide and ruthenium and/or ruthenium oxide.

6. A cathode as claimed in claim 5 wherein the electrocatalytically-active material comprises 5–90 mole % platinum and 10–80 mole % ruthenium.

7. A method for the preparation of a cathode as claimed in claim 1 which method comprises the steps of (A) depositing the outer layer of the coating on the substrate by physical vapour deposition (PVD); and (B) heating the product from Step A with the proviso that where the electrocatalytically-active material comprises cerium and/or cerium oxide the heating is carried out in a non-oxidising atmosphere.

8. A method as claimed in claim 7 wherein the target in the PVD system comprises an intermetallic compound of cerium and a non-noble Group 8 metal.

9. A method as claimed in claim 8 wherein the non-noble Group 8 metal is nickel.

10. A method as claimed in claim 7 wherein the PVD used in Step A is RF sputtering.

11. A method as claimed in claim 7 wherein the PVD in Step A is carried out in an atmosphere comprising argon.

12. A method as claimed in claim 7 wherein the non-oxidising atmosphere used in Step B comprises argon.

13. A method as claimed in claim 7 wherein in Step B the product from Step A is heated at a temperature between 300° C. and 1000° C.

14. An electrolytic cell wherein at least one cathode is a cathode as claimed in claim 1.

15. A process for the electrolysis of water or an aqueous solution carried out in an electrolytic cell as claimed in claim 14.

* * * * *